US008142087B2

(12) United States Patent
Kugimachi

(10) Patent No.: US 8,142,087 B2
(45) Date of Patent: Mar. 27, 2012

(54) PRINTING DEVICE WITH PAPER WIDTH DETECTOR MOUNTED TO CARRIAGE AND METHOD OF CONTROLLING THE PRINTING DEVICE

(75) Inventor: Hisataka Kugimachi, Fukuoka (JP)

(73) Assignee: Seiko Epson Corporation, Tokyo (JP)

( * ) Notice: Subject to any disclaimer, the term of this patent is extended or adjusted under 35 U.S.C. 154(b) by 997 days.

(21) Appl. No.: 12/079,739

(22) Filed: Mar. 28, 2008

(65) Prior Publication Data

US 2008/0240832 A1 Oct. 2, 2008

(30) Foreign Application Priority Data

Mar. 30, 2007 (JP) ..... 2007-092525

(51) Int. Cl.

| | |
|---|---|
| ***B41J 29/38*** | (2006.01) |
| ***B41J 13/00*** | (2006.01) |
| ***B65H 7/00*** | (2006.01) |
| ***B65H 7/08*** | (2006.01) |
| ***B65H 7/10*** | (2006.01) |
| ***B65H 7/06*** | (2006.01) |
| *B65H 7/14* | (2006.01) |

(52) U.S. Cl. ..... 400/76; 400/352; 347/37; 347/104

(58) Field of Classification Search ..... 400/76, 400/703, 352; 347/104; *B65H 7/10*
See application file for complete search history.

(56) References Cited

U.S. PATENT DOCUMENTS

| | | | | |
|---|---|---|---|---|
| 5,397,192 | A * | 3/1995 | Khormaee | 400/708 |
| 5,870,114 | A * | 2/1999 | Numata et al. | 347/16 |
| 7,255,343 | B2 * | 8/2007 | So | 271/262 |
| 7,456,995 | B2 * | 11/2008 | Stephens | 358/1.2 |
| 2007/0040326 | A1 * | 2/2007 | Noda et al. | 271/227 |
| 2007/0138738 | A1 * | 6/2007 | Motohashi et al. | 271/256 |

FOREIGN PATENT DOCUMENTS

| | | | |
|---|---|---|---|
| JP | 63-093344 | U | 6/1988 |
| JP | 05-024321 | | 2/1993 |
| JP | 06-183605 | A | 7/1994 |
| JP | 09-239999 | A | 9/1997 |
| JP | 10-109784 | A | 4/1998 |
| JP | 10291689 | A * | 11/1998 |
| JP | 11-193152 | A | 7/1999 |
| JP | 2003-146481 | A | 5/2003 |

* cited by examiner

*Primary Examiner* — Daniel J Colilla
(74) *Attorney, Agent, or Firm* — Nutter McClennen & Fish LLP; John J. Penny, Jr.; Christina M. Sperry

(57) ABSTRACT

An image printing device and a method of controlling the image printing device are provided. One embodiment of an image printing device includes a load unit that loads a plurality of overlapped printing media, a printing unit that performs a printing process for the printing media transported from the load unit, a moving unit that is movable in a predetermined main scanning direction, a printing medium detecting unit that is mounted to the moving unit and detects a signal relating to a presence of a printing medium, a position detecting unit that detects a position of the moving unit, and a control unit.

16 Claims, 5 Drawing Sheets

PRINTING DEVICE WITH PAPER WIDTH DETECTOR MOUNTED TO CARRIAGE AND METHOD OF CONTROLLING THE PRINTING DEVICE

Priority is claimed under 35 U.S.C. §119 to Japanese Patent Application No. 2007-092525, which is herein incorporated by reference in its entirety.

BACKGROUND

1. Technical Field

The present invention relates to an image printing device and a method of controlling the image printing device.

2. Related Art

Generally, image printing devices having a paper feeding tray that loads a plurality of paper sheets to be overlapped with one another and a print mechanism that performs a printing process for a paper sheet fed and transported from the paper feeding tray one by one have been known. As an image printing device of this type, for example, as disclosed in JP-A-5-24321, an image printing device that determines paper jam or the degree of duplicate transport by calculating the length of a paper sheet for which a printing process has been completed based on a time when the paper sheet for which the printing process has been completed passes a paper discharge detecting sensor and comparing the result of calculation with data relating to the length of the paper sheet that has been stored in a memory in advance has been proposed. It has been described that the efforts and time to cope with jam and duplicate transport can be reduced and a time for creating a document can be shortened according to the above-described image printing device.

The occurrence of duplicate transport can be generally classified by the type of discrepancy in the overlapping orientation of the printing media. Hereinafter, a duplicate transport with a vertical discrepancy refers to when at least one printing medium is not completely overlapping a first printing medium along the transport direction; a duplicate transport with a horizontal discrepancy refers to when at least one printing medium is not completely overlapping a first printing medium along the main scanning direction. However, although the above-described image printing device can determine whether duplicate transport with a vertical discrepancy (another paper sheet is overlapped and transported with a paper sheet for which a printing process has been completed in a vertically discrepant state) occurs, the image printing device cannot determined whether duplicate transport with a horizontal discrepancy (another paper sheet is overlapped and transported with a paper sheet in a printing process in a horizontally discrepant state) occurs. In addition, there may be a case where a phenomenon of skewed transport in which only one paper sheet in a printing process is transported in a state that the paper sheet is skewed. In such skewed transport, the printing process is needed to be performed again for another paper sheet. However, in a case where the duplicate transport with a horizontal discrepancy occurs, the paper sheet in the printing process can be reused for resuming the printing process. Accordingly, there has been a request for determining the duplicate transport with a horizontal discrepancy, distinguished from the skewed transport.

SUMMARY

An advantage of some aspects of at least one embodiment of the invention is that it provides an image printing device and a method of controlling the image printing device capable of determining the duplicate transport with a horizontal discrepancy, distinguished from the skewed transport.

At least one embodiment of the present invention employs the following means for achieving the above-described object.

According to a first aspect of at least one embodiment of the invention, there is provided an image printing device including: a load unit that loads a plurality of overlapped printing media; a printing unit that performs a printing process for the printing media transported from the load unit; a moving unit that is movable in a predetermined main scanning direction; a printing medium detecting unit that is mounted to the moving unit and detects a signal relating to a presence of a printing medium; a position detecting unit that detects a position of the moving unit; and a control unit that determines a change in the presence of the printing medium based on the detected signal from the printing medium detecting unit at a time when the moving unit is moved at a predetermined timing in the printing process, sets one or more measured position based on the position of the moving unit at a time when the presence of the printing medium is present changes, and determines that duplicate transport with a horizontal discrepancy occurs when a width calculated based on the measured position is approximately the same as a theoretical width and a second width calculated based on a second measured position exceeds the theoretical width by a significant value, and performs a process corresponding to the duplicate transport with a horizontal discrepancy.

According to the image printing device, it is determined a change in the presence of the printing based on the detected signal from the printing medium detecting unit at a time when the moving unit is moved at a predetermined timing in the printing process, a position of the moving unit at a time when the presence of the printing medium changes is set as a measured position, it is determined that duplicate transport with a horizontal discrepancy occurs when a width calculated based on the measured position is approximately the same as a theoretical width and a second width calculated from a second measured position exceeds the theoretical width by a significant value, and a process corresponding to the duplicate transport with a horizontal discrepancy is performed. Here, when the printing medium is normally transported, the calculated widths are approximately the same as the theoretical width consistently along the transport direction. On the other hand, when the skewed transport occurs, the calculated width is not approximately the same as the theoretical width from the start. On the other hand, when the duplicate transport with a horizontal discrepancy occurs, the first calculated width is approximately the same as the theoretical width at the start, but the subsequently calculated width exceeds the theoretical width by a significant value. Accordingly, the occurrence of the duplicate transport with a horizontal discrepancy can be determined, distinguished from a case where the skewed transport occurs, and thereby a process appropriate for the duplicate transport with a horizontal discrepancy can be performed.

In the image printing device, the control unit may employ a timing during which the moving unit is determined to traverse left and right ends of the printing medium in accordance with a maintenance request in the printing process, as the predetermined timing in the printing process. In such a case, although a determining process for duplicate transport with a horizontal discrepancy is performed, the throughput does not decrease. In other words, in order to calculate the measured width of the printing medium, the left and right ends of the printing medium are needed to be detected, and thus the printing medium detecting unit is required to traverse the left and right ends of the printing medium. When the above-described operation is performed in addition to a maintenance request in the printing process, the throughput decreases. However, here, the operation is performed at a timing determined in accordance with a maintenance request in the printing process, the throughput does not decrease.

As the maintenance in the printing process, for example, when the print unit includes a print head having a plurality of nozzles for ejecting ink, there is a flushing operation in which ink is simultaneously ejected from the plurality of nozzles in a position other than a printing area or a cleaning process in which ink is forcedly sucked from the plurality of nozzles.

In the above-described image printing device, the control unit may be configured to perform a process of stopping the printing process as the process corresponding to the duplicate transport with a horizontal discrepancy. In such a case, another printing medium overlapped with the printing medium in the printing process can be removed before it gets dirty with a coloring agent.

In the above-described image printing device, for performing the process corresponding to the duplicate transport with a horizontal discrepancy, the control unit may stop the printing process performed by the print unit and store a position of the printing medium at which the printing process for the printing medium is completed at a time when the printing process is stopped in a predetermined storage unit, and the control unit may read out the position at which the printing process is completed from the storage unit, transport the printing medium to the position at which the printing process is completed, and then control the printing unit to perform a printing process when a direction for resuming the printing process for the printing medium for which the printing process is stopped is issued. In such a case, the printing medium for which a part of the printing process has been performed is not useless, and waste of printing time can be reduced, compared to a case where the printing process is performed again from the start.

The above-described image printing device may further include a notification unit that notifies a user, and the control unit may control the notification unit to notify the user indicating that the duplicate transport with a horizontal discrepancy occurs in performing the process corresponding to the duplicate transport with a horizontal discrepancy. In such a case, when the duplicate transport with a horizontal discrepancy occurs, it can be immediately noticed to the user.

According to a second aspect of at least one embodiment of the invention, there is provided a method of controlling an image printing device that includes: a load unit that loads a plurality of overlapped printing media; a printing unit that performs a printing process for the printing media transported from the load unit one by one; a moving unit that is movable in a predetermined main scanning direction; a printing medium detecting unit that is mounted to the moving unit and detects a signal relating to a presence of a printing medium; and a position detecting unit that detects a position of the moving unit. The method includes: (a) determining a change in the presence of the printing medium based on the detected signal from the printing medium detecting unit at a time when the moving unit is moved at a predetermined timing in the printing process; and (b) setting one or more measured position based on a position of the moving unit at a time when the presence of the printing medium changes, determining that duplicate transport with a horizontal discrepancy occurs when a width calculated based on the measured position is approximately the same as a theoretical width and a second width calculated based on a second measured position exceeds the theoretical width by a significant value, and performing a process corresponding to the duplicate transport with a horizontal discrepancy.

According to the method, the change in the presence of the printing medium is determined based on the detected signal from the printing medium detecting unit at a time when the moving unit is moved at a predetermined timing in the printing process, and a position of the moving unit at a time when the presence of the printing medium changes is set as a measured position, the occurrence of the duplicate transport with a horizontal discrepancy is determined when a width calculated based on the measured position is approximately the same as a theoretical width and a second width calculated based on a second measured position exceeds the theoretical width by a significant value, and a process corresponding to the duplicate transport with a horizontal discrepancy is performed. Here, when the printing medium is normally transported, the calculated widths are approximately the same as the theoretical width consistently along the transport direction. On the other hand, when the skewed transport occurs, the calculated width is not approximately the same as the theoretical width from the start. On the other hand, when the duplicate transport with a horizontal discrepancy occurs, the calculated width is approximately the same as the theoretical width at the start, but at least one other calculated width exceeds the theoretical width by a significant value. Accordingly, the occurrence of the duplicate transport with a horizontal discrepancy can be determined, distinguished from a case where the skewed transport occurs, and thereby a process appropriate for the duplicate transport with a horizontal discrepancy can be performed.

BRIEF DESCRIPTION OF THE DRAWINGS

One embodiment of the invention will be described with reference to the accompanying drawings, wherein like numbers reference like elements.

DESCRIPTION OF EXEMPLARY EMBODIMENTS

Figure 1:
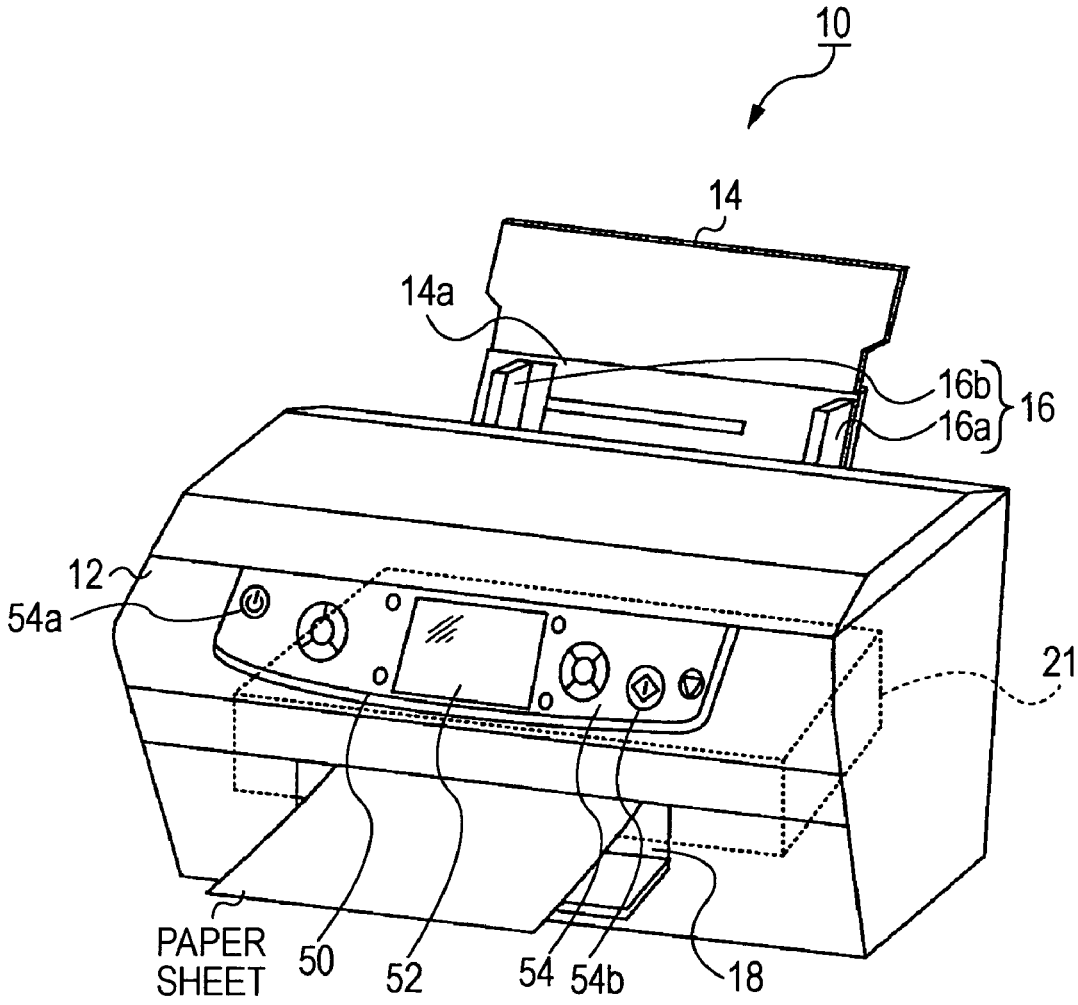
FIG. 1 is a perspective view of an ink jet printer 10 according to an embodiment of the invention.
Figure 2:
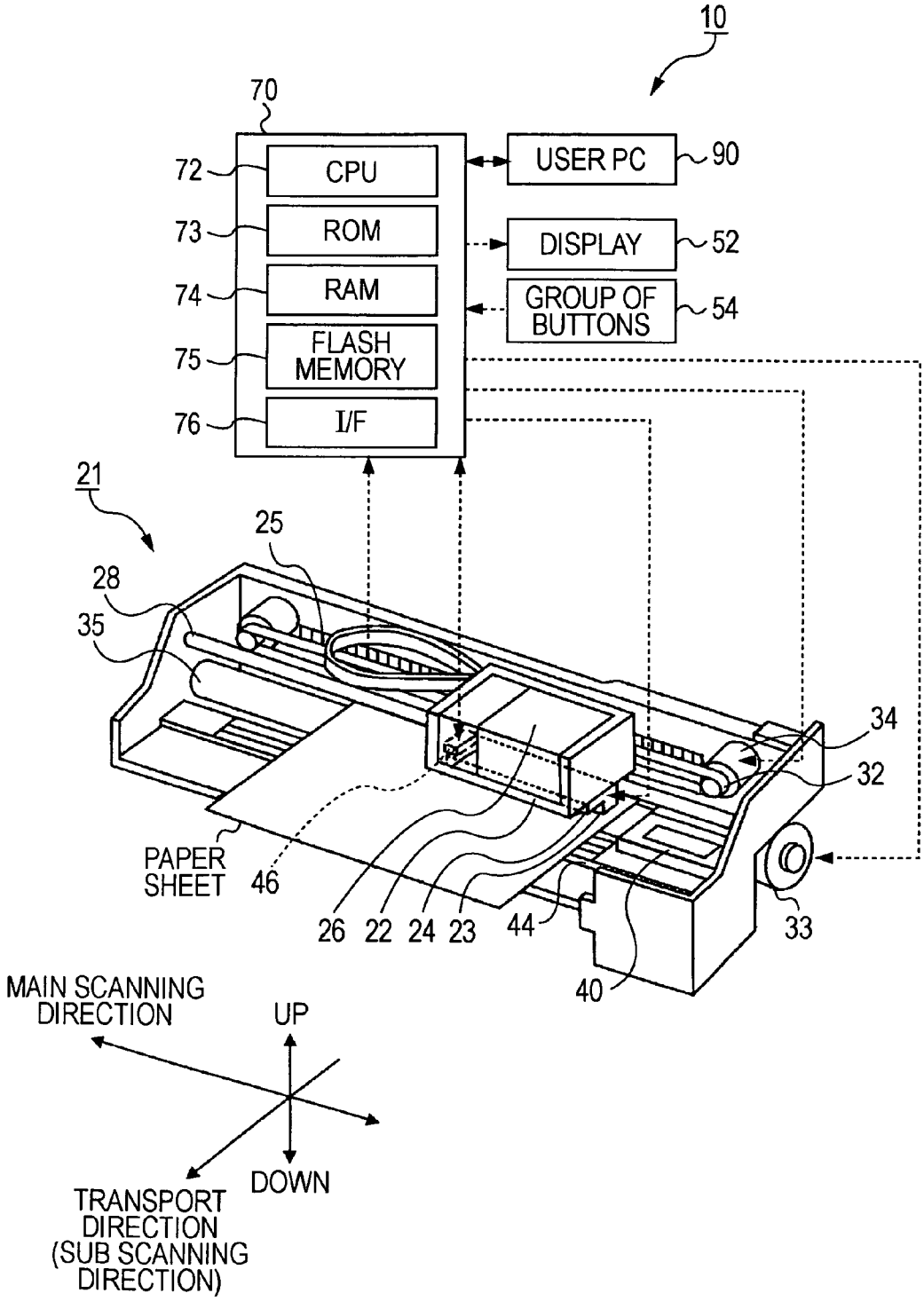
FIG. 2 is a schematic diagram showing the configuration of the ink jet printer 10.
Figure 3:
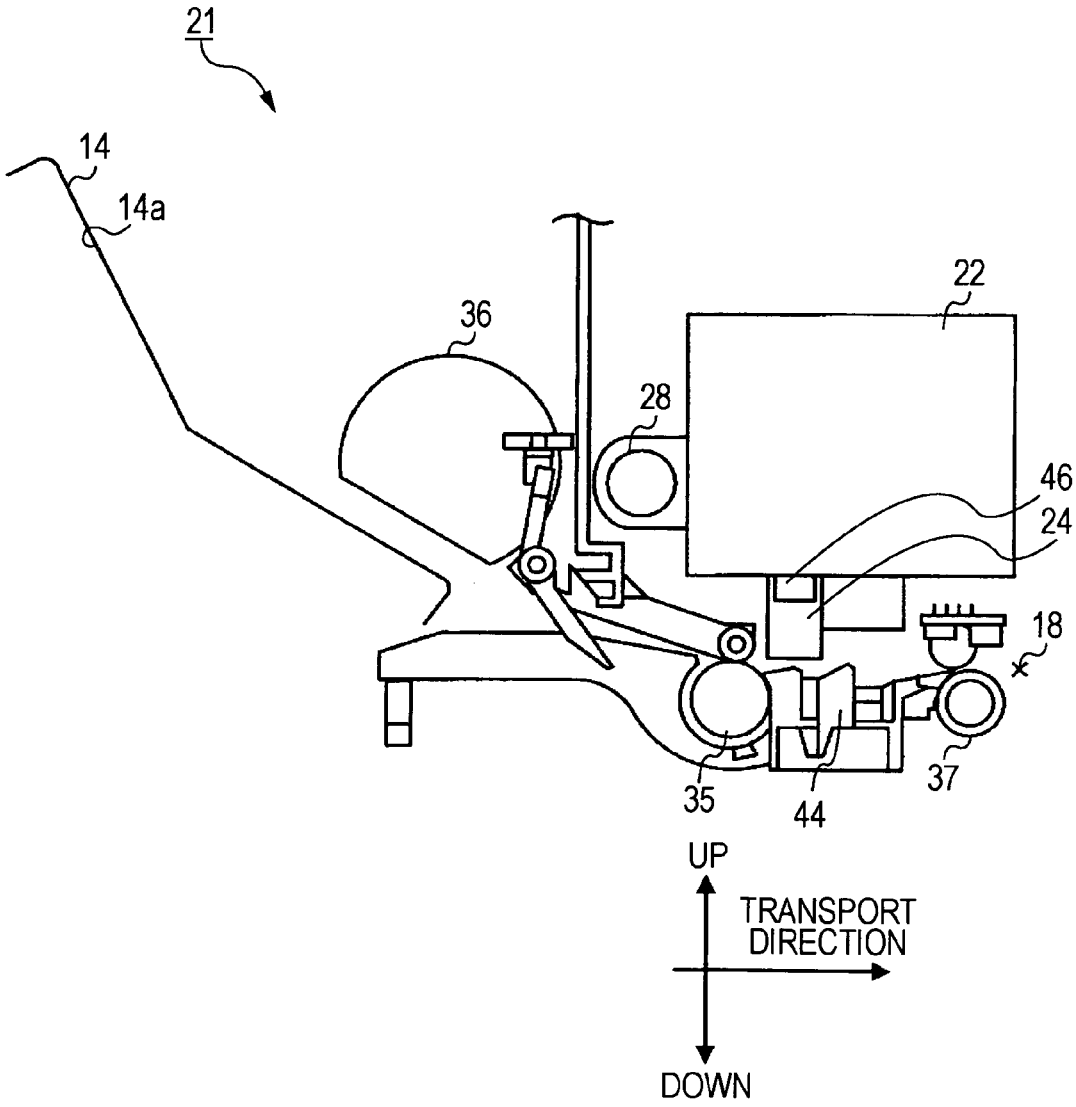
FIG. 3 is a schematic sectional view of a printer mechanism 21 according to an embodiment of the invention.

Hereinafter, an embodiment of the present invention will be described with reference to the accompanying drawings. FIG. 1 is a perspective view of an ink jet printer 10 according to an embodiment of the invention. FIG. 2 is a schematic diagram showing the configuration of the ink jet printer 10. FIG. 3 is a schematic sectional view of a printer mechanism 21 according to an embodiment of the invention.

The ink jet printer 10 according to this embodiment, as shown in FIG. 1, includes a paper feeding tray 14 that is disposed on the rear side of a casing 12 and loads a paper sheet, a printer mechanism 21 that performs a printing process by ejecting ink droplets onto the paper sheet fed from the paper feeding tray 14 and discharges the printed paper sheet from a discharge port 18 disposed on the front side of the casing 12, a display 52 that displays various information, an operation panel 50 on which a group of buttons 54 is provided, and a controller 70 (see FIG. 2) that controls the whole ink jet printer 10.

The paper feeding tray 14 has a paper guide 16 that guides a paper sheet loaded on a paper feeding surface 14*a* so as to be fed and transported correctly. The paper guide 16, as shown in FIG. 1, includes a fixing part 16*a* that is assembled on the paper feeding surface 14*a* of the paper feeding tray 14 and is fixed in the right end of the paper feeding surface 14*a* and a moving part 16*b* that is installed to the left end of the paper feeding surface 14*a* and can be sled so as to freely change a guide width in accordance with the size (for example, a postcard size, an envelope size, an A4 size, or the like) of the paper sheet. When a paper sheet is to be loaded in the paper feeding tray 14, the right end of the paper sheet is brought into contact with the fixing part 16*a* and the moving part 16*b* is sled so as to be brought into contact with the left end of the paper sheet, so that the guide width is adjusted to the width of the paper sheet. The paper sheet loaded in the paper feeding tray 14, as shown in FIG. 3, is supplied to a position below a print head 24 by a paper feed roller 36, transported by the paper feed roller 35 and the paper discharge roller 37, and discharged from the discharge port 18. The paper feed roller 36, the paper transport roller 35 and the paper discharge roller 37 are driven by a drive motor 33 (see FIG. 2) through a gear mechanism not shown in the figure. Although simultaneously feeding of a plurality of paper sheets is prevented due to an abrasive resistance between a rotational drive force of the paper feed roller 36 and a separation pad not shown in the figure, however, the effect of the prevention can not be determined to be exhibited all the time.

The printer mechanism 21, as shown in FIG. 2, includes a paper feed roller 35 that transports a paper sheet on a platen 44, a drive motor 33 that drives the paper feed roller 35 to be rotated, a carriage 22 that is reciprocated horizontally (in the main scanning direction) along a guide 28 by a carriage belt 32 and a carriage motor 34, ink cartridges 26 that are mounted on the carriage 22 and individually houses ink of yellow (Y), magenta (M), cyan (C), and black (K) colors, a print head 24 that applies pressure to the ink supplied from each ink cartridge 26, and nozzles 23 that eject ink droplets pressed by the print head 24 onto a paper sheet. On the rear side of the carriage 22, a linear-type encoder 25 that detects the position of the carriage 22 is disposed, and the position of the carriage 22 is configured to be manageable by using the linear-type encoder 25. In addition, on the left side of the print head 24, a PW (paper width) detector 46 that detects left and right end portions of a paper sheet is disposed. Near the right end of the platen 44, a capping device 40 is formed. The print head 24 may employ a method in which ink is pressed by air bubbles generated by applying voltage to a heating resistor (for example, a heater or the like) for heating the ink.

The PW detector 46 is a photo sensor constituted by a light emitting element that emits light toward a paper sheet using an LED and a light receiving element that receives reflection light reflected from the paper sheet and outputs a voltage on the basis of intensity of the received light. The PW detector 46 is disposed on the left side of the print head 24. The PW detector 46 is a reflection-type photo interrupter that receives light, which has been emitted from the light emitting element, reflected from a target paper sheet or the platen 44 using the light receiving element and changes its output voltage level in correspondence with the intensity of the received light while being moved by the carriage 22 in the main scanning direction. The output voltage level of the PW detector 46 for a case where light reflected from the paper sheet is received is higher than that for a case where light reflected from the platen 44 is received. Accordingly, when an approximate center output voltage level is set as a reference voltage Vth, it can be determined that there is a paper sheet under the PW detector 46 in a case where the output voltage level exceeds the reference voltage Vth and that there is not a paper sheet under the PW detector 46 in a case where the output voltage level is equal to or smaller than the reference voltage Vth. In descriptions below, when the output voltage is represented to be switched from a high level to a low level, it means that the output voltage level is switched from a state that the output voltage level exceeds the reference voltage Vth to a state that the output voltage level is equal to or smaller than the reference voltage Vth.

The capping device 40 is formed in a position deviated from a printable area of the platen 44 to the right side in FIG. 2. The capping device has an approximate rectangular parallelepiped shape and includes a casing having an uncovered top side. The capping device 40 is used for sealing the print head 24, so that dryness of the print head 24 in a period when a printing process is paused or the like is prevented. In addition, the capping device 40 is used for so-called a flushing operation, that is, an operation for ejecting ink droplets regardless of print data on a regular basis or at predetermined timing for preventing solidification of ink due to its dryness in the front end of the nozzle 23. A position above the capping device 40 is also called home position.

The operation panel 50, as shown in FIG. 1, has a display 52 disposed in its center and a group of buttons 54 in the periphery of the display 52. The group of buttons 54 includes a plurality of buttons such as a power button 54*a* and a start button 54*b* for resuming a printing process after a copy process or paper jam.

The controller 70, as shown in FIG. 2, is configured as a microprocessor having a CPU 72 as its center. The controller 70 includes a ROM 73 that stores various processing programs such as a print control routine, a RAM 74 that temporality stores or preserves data, a flash memory 75 in which data can be recorded or deleted, an interface (I/F) 76 that exchanges information with external devices, and input/output ports not shown in the figure. To the controller 70, a control signal from the operation panel 50, an On/Off signal from the power button 54*a*, a detection signal from the PW detector 46, a rotation angle of the paper transport roller 35, and the like are input though an input port not shown in the figure. In addition, a print job or the like is input to the controller 70 from the user PC 90 through the I/F 76. From the controller 70, a control signal for the print head 24, a control signal for the drive motor 33, a display directing signal for the display 52, a detection directing signal for the PW detector 46, and the like are output though an output port not shown in the figure. In addition, print status information or the like is output from the controller 70 to the user PC 90 through the I/F 76.

Figure 4:
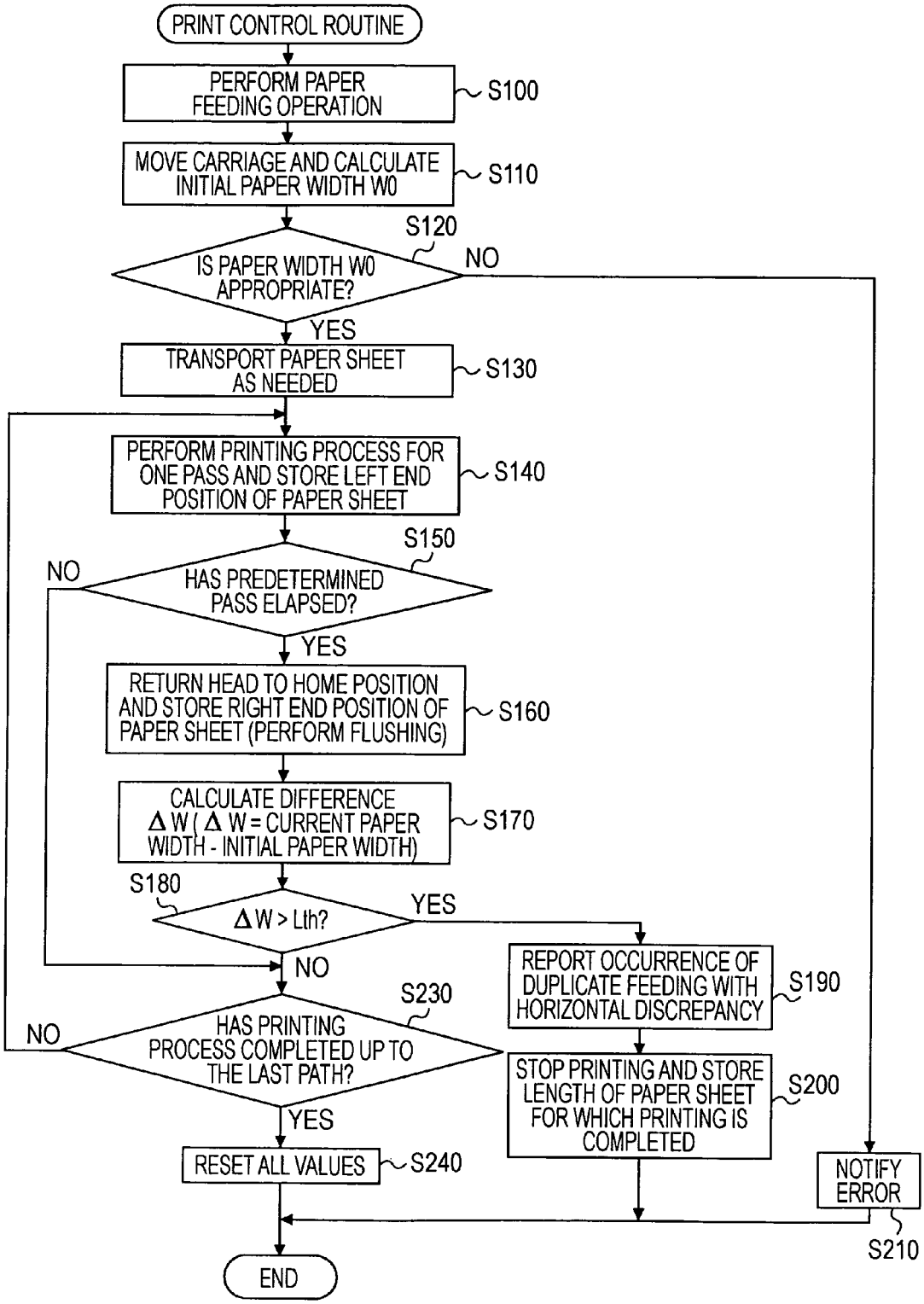
FIG. 4 is a flowchart showing an example of a print control routine according to an embodiment of the invention.

Next, the operation of the above-described ink jet printer 10 according to this embodiment, and more particularly, an operation for performing a printing process for a paper sheet will be described. FIG. 4 is a flowchart showing an example of a print control routine. The program for this routine is stored in the ROM 73, and is executed by the CPU 72 in a case where a print job is received from the user PC through the I/F 76.

When this routine is started, first, the CPU 72 starts a paper feeding operation (Step S100). In other words, by rotating the paper feed roller 36 and the paper transport roller 35, the front end of a paper sheet loaded in the paper feeding tray 14 is configured to reach a position below the print head 24, and the paper sheet is temporarily stopped at the position. Subsequently, an initial paper width W0 of the paper sheet is acquired based on the output voltage of the PW detector 46 in a case where the carriage 22 is moved horizontally (Step S110). In other words, a position of the PW detector 46 at a time when the output voltage of the PW detector 46 is switched from a high level to a low level in a case where the carriage 22 positioned in the home position is moved to the left side in FIG. 2 is determined as a left end position of the paper sheet. Thereafter, a position of the PW detector 46 at a time when the output voltage of the PW detector 46 is switched from the high level to the low level in a case where the carriage 22 is moved to the right side in FIG. 2 is determined as a right end position of the paper sheet. Then, a difference between the left end position and the right end position is determined as the initial paper width W0 of the paper sheet and is stored in the RAM 74. Subsequently, it is determined whether the initial paper width W0 is identical to a theoretical width (Step S120). For example, when paper setting information of the print job which has been transmitted from the user PC 90 is a vertical direction of an L size (89×127 mm), if the initial paper width W0 is identical to 89 mm (the theoretical width), the paper sheet is determined to be appropriate. On the other hand, if the initial paper width W0 is not identical to 89 mm, the paper sheet is determined to be inappropriate. To be identical to the theoretical width means that the paper width is within a range calculated by adding an allowable amount to the theoretical width. When the initial paper width W0 and the theoretical width are not identical to each other in Step S120, there is a high probability that a paper sheet of a wrong size is set or a paper sheet is skewed with respect to the transport direction, and thus an error message is displayed in the display 52 (Step S210), and then the routine ends.

Figure 5:
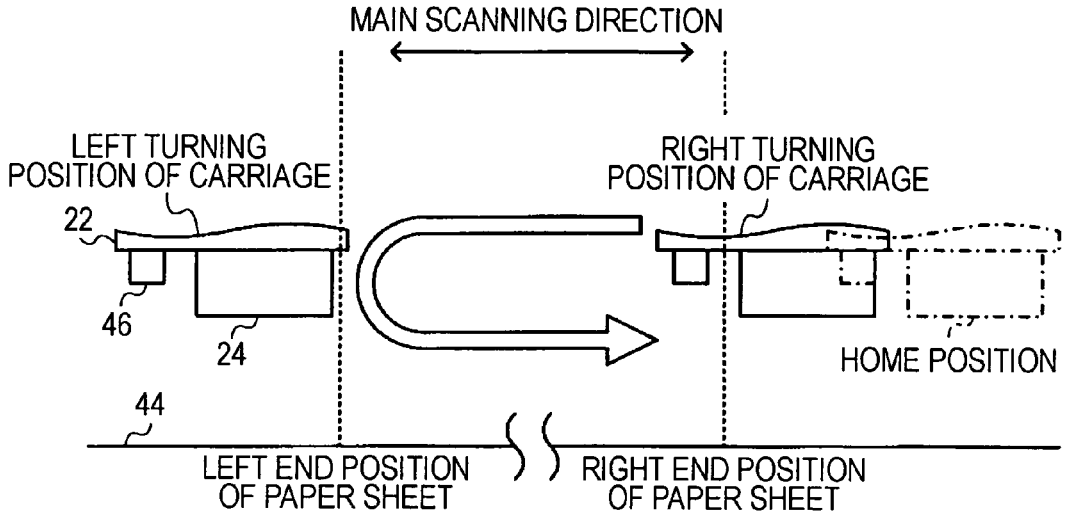
FIG. 5 is a diagram showing movement of a carriage 22 for performing a printing process for two passes according to an embodiment of the invention.

On the other hand, when the initial paper width W0 is identical to the theoretical width in Step S120, the paper sheet is transported as is needed (Step S130). In other words, when a margin from the front end inset in the print job or a paper length, to be described later, for which a printing process is completed is set, the paper sheet is transported in accordance with the margin or the paper length for which the printing process is completed, and the print starting position of the paper sheet is configured to be in a position right below the print head 24. Subsequently, the carriage 22, the print head 24, the paper transport roller 35, and the like are driven for performing a printing process for one pass and the left end position of the paper sheet is acquired (Step S140). FIG. 5 is a diagram showing movement of the carriage 22 for performing a printing process for two passes. The carriage 22 is moved such that the print head 24 is disposed from the right side of the right end position of the paper sheet to a left-side position (right turning position in FIG. 5) of the home position. Then, ink is ejected from the nozzle 23 of the print head 24 while the carriage 22 is moved from the position to the left side. After the print head 24 reaches the left side (left turning position in FIG. 5) of the left end position of the paper sheet, the paper feed roller 35 is driven so as to transport the paper sheet in the transport direction (sub scanning direction) by a predetermined distance, and ink is ejected from the nozzle 23 of the print head 24 while the carriage 22 is moved to the right side. As described above, one-way movement between the left and right turning positions is referred to as one pass. Then, each time a printing process for one pass is performed, the number of passes is counted up and is stored in the RAM 74. In addition, the PW detector 46, as shown in FIG. 5, does not traverse the right end of the paper sheet between the left turning position to the right turning position, and thus the right end position of the paper sheet cannot be detected. However, the PW detector 46 traverses the left end of the paper sheet between the right turning position to the left turning position, and accordingly, the left end position of the paper sheet can be detected. Accordingly, a position at a time when the output voltage of the PW detector 46 is switched from the high level to the low level between the right turning position to the left turning position is determined as the left end position of the paper sheet, and is stored in the RAM 74. It is assumed that the left end position of the paper sheet is configured to be stored in the RAM 74.

The CPU 72 determines whether the number of passes reaches a predetermined number of passes each time a printing process for one pass is completed (Step S150). Here, the predetermined number of passes according to this embodiment is set to the number of passes required for performing a flushing operation. The flushing operation is performed for preventing solidification of ink ejected from the nozzle 23 and represents simultaneously ejecting ink of a predetermined amount from all the nozzles 23 of the print head 24 toward the capping device 40 after the carriage 22 is returned to the home position. The interval for the flushing operation is set to be several passes to several tens of passes. For example, when the paper sheet is set to be a vertical direction of 4 inch×6 inch, the flushing operation is set to be performed four to six times until the printing process is completed. When the number of passes has not reached the predetermined number of passes in Step S150, it is determined whether the printing process has been performed up to the last pass (Step S230). When the printing process has not been performed up to the last pass, the process proceeds back to Step S140, and a printing process for the next one pass is performed. On the other hand, when it is determined that the number of passes has reached the predetermined number of passes in Step S150, the carriage 22 is returned to the home position, the right end position of the paper sheet is stored, and the flushing operation is performed (Step S160). In other words, since the PW detector 46 traverses the right end of the paper sheet while the carriage 22 is moved from the right turning position to the further right side so as to reach the home position, a position at a time when the output voltage of the PW detector 46 is switched from the high level to the low level is determined as the right end position of the paper sheet, and the current paper width W is calculated by subtracting the right end position from the latest left end position that is stored in the RAM 74. In Step S160, the number of passes is reset to be zero.

Subsequently, a difference ΔW that is a value resulted from subtracting the initial paper width W0 from the current paper width W is calculated (Step S170), and it is determined whether the difference ΔW exceeds a threshold value Lth (Step S180). Here, the difference ΔW becomes substantially zero when only one paper sheet is transported straight without being overlapped with another paper sheet. On the other hand, when another paper sheet is overlapped with and added to the paper sheet with a horizontal discrepancy, the difference ΔW is substantially zero if the PW detector 46 detects the paper sheet only. However, if another paper sheet that is overlapped with a horizontal discrepancy is detected by the PW detector 46, the paper width W comes to have a larger value comparing with the theoretical width, and the difference ΔW becomes a significant value. A difference ΔW is experimentally acquired in advance for a case where the duplicate transport with a horizontal discrepancy occurs, and the threshold value Lth is set on the basis of the value of the difference ΔW.

When the difference ΔW does not exceed the threshold value Lth in Step S180, it is determined whether a printing process up to the last pass has been completed (Step S230). When the printing process up to the last pass has not been completed, the process proceeds back to Step S140, and a printing process for the next one pass is performed. On the other hand, when the difference ΔW exceeds the threshold value Lth in Step S180, an error message indicating occurrence of duplicate transport with a horizontal discrepancy is displayed on the display 52 (Step S190), the printing process is stopped, the paper length for which the printing process has been completed at that moment is calculated based on the number of rotations of the paper transport roller 35 or the like and is stored in the RAM 74 (Step S200), and this routine ends. The paper length for which the printing process has been completed is used in Step S130 of the print control routine which is performed after the paper sheet in the printing process is set in the paper feeding tray 14 again and resuming the printing process is directed. When the printing process up to the last pass has been completed in Step S230, the left end position, the left and right end positions of the paper sheet, the number of passes, and the like are reset (Step S240), and this routine ends.

Figure 6A:
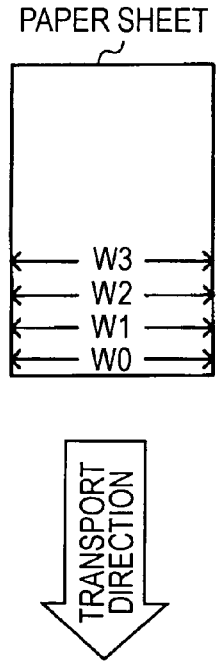
FIGS. 6A to 6C are diagrams showing changes in a paper width W for cases where skewed transport or duplicate transport with a horizontal discrepancy occurs.
Figure 6B:
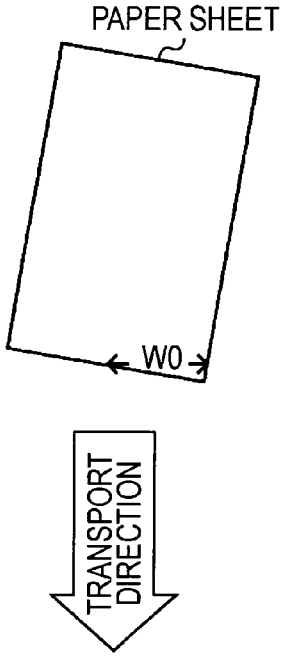
Figure 6C:
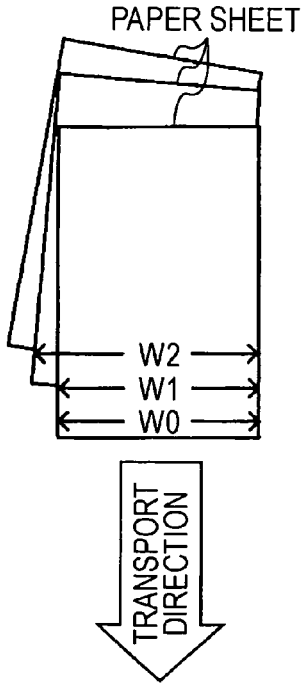

Next, the process of the above-described print control routine for a case where a paper sheet is normally transported and a case where duplicate transport with a horizontal discrepancy occurs will be described with reference to FIGS. 6A to 6C. FIGS. 6A to 6C are diagrams showing changes in the paper width W for the above-described cases. Here, a paper width W and a difference ΔW which are calculated for the n-th time after printing is started are represented by a paper width Wn and a difference ΔWn. When a paper sheet is transported after being normally set as shown in FIG. 6A, that is, when the paper sheet matches the paper size and direction that are set in a print job and the paper sheet is transported straight (the vertical side of the paper sheet is transported in accordance with the transport direction), the initial paper width W0 is identical to the theoretical width, and thus, it is determined that the initial paper width is identical to the theoretical width in S120. In addition, the paper widths W1, W2, W3, . . . are identical to the theoretical width and the differences ΔW1, ΔW2, ΔW3, . . . substantially become zero, and accordingly, the differences are determined not to exceed the threshold value Lth in Step S180. On the other hand, when a paper sheet is set to be skewed (the vertical side of the paper sheet is set to be skewed from the transport direction) as shown in FIG. 6B, the initial paper width W0 is not identical to the theoretical width, and accordingly, it is determined that the initial paper width is not identical to the theoretical width in S120. On the other hand, when duplicate transport with a horizontal discrepancy occurs as shown in FIG. 6C, the initial paper width W0 is identical to the theoretical width, and accordingly, it is determined that the initial paper width is identical to the theoretical width in S120. When the PW detector 46 detects only a paper sheet, the paper widths W1, W2, . . . becomes an approximately same value (the paper width W1). However, when another paper sheet that is overlapped with horizontal discrepancy is detected by the PW detector 46, the paper width suddenly comes to have a value (paper width W2) larger than previous values, and the difference ΔW2 (=W2−W0) exceeds the threshold value Lth, and accordingly, the difference is determined to exceed the threshold value Lth in Step S180. As described above, since the print control routine can assuredly determine a case where a paper sheet is normally transported, a case where skewed transport occurs, and a case where duplicate transport with a horizontal discrepancy occurs in Steps S120 and S180, a process appropriate for each case can be performed. When a user performs a printing process by pressing the moving part 16*b* of the paper guide 16 to the left side of the paper sheet in a state that the right side of the paper sheet is pressed to the fixing part 16*a* of the paper guide 16, there is a rare case where the skewed transport or the duplicate transport with a horizontal discrepancy occurs. However, when the user performs a printing process without pressing the moving part 16*b* to the left side of the paper sheet, there is a possibility that the skewed transport or the duplicate transport with a horizontal discrepancy occurs.

Here, the correspondence relationship between constituent elements according to this embodiment and constituent elements of the present invention will be clarified. The ink jet printer 10 according to this embodiment corresponds to the image printing device according to invention, the paper feeding tray 14 corresponds to the load unit, the printer mechanism 21 corresponds to the print unit, the carriage 22 corresponds to the moving unit, the PW detector 46 corresponds to the printing medium detecting unit, the linear-type encoder 25 corresponds to the position detecting unit, the CPU 72 corresponds to the control unit, the display 52 corresponds to the notification unit, and the RAM 74 corresponds to the storage unit. In this embodiment, by describing the operation of an image printing device, an example of a method of controlling an image printing device according to an embodiment of the invention is clearly disclosed.

In the above described ink jet printer 10 according to this embodiment, the right and left end positions of a paper sheet are detected based on the output voltage level of the PW detector 46 at a time when the carriage 22 is moved each timing of the flushing operation in a printing process, and the initial paper width W (that is, the paper width W0) calculated based on the right and left end positions is approximately the same as the theoretical width, at first. However, thereafter, when the paper width exceeds the theoretical width by a significant value, the occurrence of the duplicate transport with a horizontal discrepancy is determined. Accordingly, the occurrence of the duplicate transport with a horizontal discrepancy is notified to the user, and the printing process is stopped. Therefore, it can be determined that the duplicate transport with a horizontal discrepancy occurs, to be distinguished from a case where the skewed transport occurs, and thereby a process appropriate for the duplicate transport with a horizontal discrepancy can be performed. Conversely, in the case when a skewed transport has been determined, a process appropriate for the skewed transport can be performed.

In addition, when the duplicate transport with a horizontal discrepancy occurs, the printing process is stopped, and thus, another paper sheet overlapped with the paper sheet in the printing process can be removed before it gets dirty with ink. In addition, since the printing process is performed for the paper sheet in the printing process again, the paper sheet and the ink do not become useless. In addition, since the occurrence of the duplicate transport with a horizontal discrepancy can be immediately notified to the user, the user can cope with the problem in a speedy manner.

In addition, the occurrence of duplicate transport with a horizontal discrepancy is determined for each timing of the flushing operation, the throughput is not decreased, compared to a case where the occurrence of duplicate transport with a horizontal discrepancy is not determined.

In addition, the present invention is not limited to the above-described embodiment, and it is apparent that the present invention can be performed in various forms without departing from the technical scope of the invention.

For example, in the above-described embodiment, a position at a time when the output voltage of the PW detector 46 is switched from the high level to the low level is determined as the left end position of the paper sheet while the carriage 22 moves to the left side, and a position at a time when the output voltage of the PW detector 46 is switched from the high level to the low level is determined as the right end position of the paper sheet while the carriage 22 moves to the right side. However, while the carriage 22 moves from a position having a column number of zero that is the home position to a position having a maximum column number, a position at a time when the output voltage of the PW detector 46 is switched from the low level to the high level may be determined as the right end position of the paper sheet, and a position at a time when the output voltage is switched from the high level to the low level may be determined as the left end position of the print sheet. Alternatively, while the carriage 22 moves from a position having a maximum column number to a position having a column number of zero, a position at a time when the output voltage of the PW detector 46 is switched from the low level to the high level may be determined as the left end position of the paper sheet, and a position at a time when the output voltage is switched from the high level to the low level may be determined as the right end position of the paper sheet.

In the above-described embodiment, the difference ΔW is defined as a value resulted from subtracting the initial paper width W0 from the current paper width W. However, the difference ΔW may be defined as a value resulted from subtracting the previous paper width W from the current paper width W. In such a case, between the previous process and the current process, a time required for printing a predetermined number of passes elapses. Accordingly, the difference ΔW may be considered as a variable function of time, for example, a change ratio of the paper width W to time.

In the above-described embodiment, a measured width is calculated based on the positions of the left and right ends of the paper sheet. However, it may be assumed that the whole right side of the paper sheet is brought into contact with the fixing part 16*a* of the paper guide 16 and the left end position of the paper sheet may be regarded as the measured width. In such a case, when a paper sheet is transported after being normally set, the left end position of the paper sheet is the same position (a position apart by a theoretical width from the fixing part, and this position is referred to as a theoretical position) for each time. On the other hand, when the paper is set to be skewed, the left end position of the paper sheet becomes a position different from the theoretical position from the start. On the other hand, when the duplicate transport with a horizontal discrepancy occurs, the left end position of the paper sheet is the theoretical position initially, and thereafter the left end position of the paper sheet becomes a position different from the theoretical position. Accordingly, even when the left end position of the paper sheet is used instead of the paper width W according to the above-described embodiment, similarly to the above-described embodiment, the occurrence of the duplicate transport with a horizontal discrepancy can be determined, distinguished from a case where skewed transport occurs.

In the above-described embodiment, the occurrence of the duplicate transport with a horizontal discrepancy is determined for each timing for a flushing operation. However, instead of the determination or in addition to the determination, the determination processes may be performed at each timing for a cleaning process in which ink from each nozzle is forcedly sucked by using a suction pump after the print head 24 is covered with the capping device 40. Alternatively, the occurrence of the duplicate transport with a horizontal discrepancy may be determined at timings other than timings for the flushing operation or the cleaning operation. For example, the determination process may be performed for each printing process for one pass or for several passes.

In addition, in the above-described embodiment, although a paper guide 16 having one side fixed and the other side movable has been described, a guide having both sides movable may be used.

What is claimed is:

1. An image printing device comprising:

a load unit that loads a plurality of overlapped printing media;

a printing unit that performs a printing process for the printing media transported from the load unit;

a moving unit that is movable in a predetermined main scanning direction;

a printing medium detecting unit that is mounted to the moving unit and detects a signal relating to a presence of a printing medium;

a position detecting unit that detects a position of the moving unit; and a control unit that determines a change in the presence of the printing medium based on the detected signal from the printing medium detecting unit at a time when the moving unit is moved at a predetermined timing in the printing process, stores a first set of measured positions based on the position of the moving unit at a time when the presence of the printing medium changes, calculates a first width using the first set of measured positions, calculates a second width using a second set of measured positions, determines that duplicate transport with a horizontal discrepancy has occurred when the first width calculated using the first set of measured positions is approximately the same as a theoretical width and the second width exceeds the theoretical width by a significant value, and performs a process corresponding to the duplicate transport with a horizontal discrepancy, wherein the predetermined timing is when the moving unit is determined to traverse left and right ends of the printing medium in accordance with a maintenance request in the printing process.

2. The image printing device according to claim 1, wherein the control unit performs a process of stopping the printing process as the process corresponding to the duplicate transport with a horizontal discrepancy.

3. The image printing device according to claim 1, further comprising a notification unit that notifies a user, wherein the control unit controls the notification unit to notify the user that the duplicate transport with a horizontal discrepancy has occurred.

4. An image printing device comprising:

a load unit that loads a plurality of overlapped printing media;

a printing unit that performs a printing process for the printing media transported from the load unit;

a moving unit that is movable in a predetermined main scanning direction;

a printing medium detecting unit that is mounted to the moving unit and detects a signal relating to a presence of a printing medium;

a position detecting unit that detects a position of the moving unit; and a control unit that determines a change in the presence of the printing medium based on the detected signal from the printing medium detecting unit at a time when the moving unit is moved at a predetermined timing in the printing process. stores a first set of measured positions based on the position of the moving unit at a time when the presence of the printing medium changes, calculates a first width using the first set of measured positions, calculates a second width using a second set of measured positions, determines that duplicate transport with a horizontal discrepancy has occurred when the first width calculated using the first set of measured positions is approximately the same as a theoretical width and the second width exceeds the theoretical width by a significant value, and performs a process corresponding to the duplicate transport with a horizontal discrepancy, wherein, when it has been determined that duplicate transport with a horizontal discrepancy has occurred, the control unit stops the printing process performed by the print unit and stores, in a predetermined storage unit, a position of the printing medium at which the printing process for the printing medium has been completed, and wherein, when a direction for resuming the printing process, for the printing medium for which the printing process has been stopped, is issued, the control unit reads out the position, from the storage unit, at which the printing process is completed, transports the printing medium to the position at which the printing process had been completed, and controls the printing unit to perform a printing process.

5. The image printing device according to claim 4, wherein the control unit performs a process of stopping the printing process as the process corresponding to the duplicate transport with a horizontal discrepancy.

6. The image printing device according to claim 4, further comprising a notification unit that notifies a user, wherein the control unit controls the notification unit to notify the user that the duplicate transport with a horizontal discrepancy has occurred by performing the process corresponding to the duplicate transport with a horizontal discrepancy.

7. A method of controlling an image printing device that comprises a load unit that loads a plurality of overlapped printing media; a printing unit that performs a printing process for the printing media transported from the load unit; a moving unit that is movable in a predetermined main scanning direction; a printing medium detecting unit that is mounted to the moving unit and detects a signal relating to a presence of a printing medium; and a position detecting unit that detects a position of the moving unit, the method comprising:

(a) determining a change in the presence of the printing medium based on the detected signal from the printing medium detecting unit at a time when the moving unit is moved at a predetermined timing in the printing process; and (b) storing a first set of measured positions of the moving unit at a time when the presence of the printing medium changes, calculating a first width using the first set of measured positions, calculating a second width using a second set of measured positions, determining that duplicate transport with a horizontal discrepancy has occurred when the first width calculated using the first set of measured positions is approximately the same as a theoretical width and the second width exceeds the theoretical width by a significant value, and performing a process corresponding to the duplicate transport with a horizontal discrepancy.

wherein the predetermined timing is when the moving unit is determined to traverse left and right ends of the printing medium in accordance with a maintenance request in the printing process.

8. An image printing device comprising:

a paper tray that loads a plurality of overlapped printing media;

a printer mechanism that performs a printing process for the printing media transported from the paper tray;

a carriage that is movable in a predetermined main scanning direction;

a printing medium detector that is mounted to the carriage and detects a signal relating to a presence of a printing medium;

a position detector that detects a position of the carriage; and a controller that determines a change in the presence of the printing medium based on the detected signal from the printing medium detector at a time when the carriage is moved at a predetermined timing in the printing process, stores a first set of measured positions based on the position of the carriage at a time when the presence of the printing medium changes, calculates a first width using the first set of measured positions, calculates a second width using a second set of measured positions, determines that duplicate transport with a horizontal discrepancy has occurred when the first width calculated using the first set of measured positions is approximately the same as a theoretical width and the second width exceeds the theoretical width by a significant value, and performs a process corresponding to the duplicate transport with a horizontal discrepancy, wherein the predetermined timing is when the moving unit is determined to traverse left and right ends of the printing medium in accordance with a maintenance request in the printing process.

9. The image printing device according to claim 8, wherein the controller performs a process of stopping the printing process as the process corresponding to the duplicate transport with a horizontal discrepancy.

10. The image printing device according to claim 8, further comprising a notifier that notifies a user, wherein the controller controls the notifier to notify the user that the duplicate transport with a horizontal discrepancy has occurred.

11. An image printing device comprising:

a paper tray that loads a plurality of overlapped printing media;

a printer mechanism that performs a printing process for the printing media transported from the paper tray;

a carriage that is movable in a predetermined main scanning direction;

a printing medium detector that is mounted to the carriage and detects a signal relating to a presence of a printing medium;

a position detector that detects a position of the carriage; and a controller that determines a change in the presence of the printing medium based on the detected signal from the printing medium detector at a time when the carriage is moved at a predetermined timing in the printing process, stores a first set of measured positions based on the position of the carriage at a time when the presence of the printing medium changes, calculates a first width using the first set of measured positions, calculates a second width using a second set of measured positions, determines that duplicate transport with a horizontal discrepancy has occurred when the first width calculated using the first set of measured positions is approximately the same as a theoretical width and the second width exceeds the theoretical width by a significant value, and performs a process corresponding to the duplicate transport with a horizontal discrepancy, wherein, when it has been determined that duplicate transport with a horizontal discrepancy has occurred, the controller stops the printing process performed by the printer mechanism and stores, in a predetermined memory, a position of the printing medium at which the printing process for the printing medium has been completed, and wherein, when a direction for resuming the printing process, for the printing medium for which the printing process has been stopped, is issued, the controller reads out the position, from the memory, at which the printing process is completed, transports the printing medium to the position at which the printing process had been completed, and then controls the printer mechanism to perform a printing process.

12. The image printing device according to claim 11, wherein the controller performs a process of stopping the printing process as the process corresponding to the duplicate transport with a horizontal discrepancy.

13. The image printing device according to claim 11, further comprising a notifier that notifies a user, wherein the controller controls the notifier to notify the user that the duplicate transport with a horizontal discrepancy has occurred by performing the process corresponding to the duplicate transport with a horizontal discrepancy.

14. A method of controlling an image printing device that comprises a paper tray that loads a plurality of overlapped printing media; a printing mechanism that performs a printing process for the printing media transported from the paper tray; a carriage that is movable in a predetermined main scanning direction; a printing medium detector that is mounted to the carriage and detects a signal relating to a presence of a printing medium; and a position detector that detects a position of the carriage, the method comprising:

(a) determining a change in the presence of the printing medium based on the detected signal from the printing medium detector at a time when the carriage is moved at a predetermined timing in the printing process; and (b) storing a first set of measured positions of the carriage at a time when the presence of the printing medium changes, calculating a first width using the first set of measured positions, calculating a second width using a second set of measured positions, determining that duplicate transport with a horizontal discrepancy has occurred when the first width calculated using the first set of measured positions is approximately the same as a theoretical width and the second width exceeds the theoretical width by a significant value, and performing a process corresponding to the duplicate transport with a horizontal discrepancy, wherein the predetermined timing is when the moving unit is determined to traverse left and right ends of the printing medium in accordance with a maintenance request in the printing process.

15. A method of controlling an image printing device that comprises a load unit that loads a plurality of overlapped printing media; a printing unit that performs a printing process for the printing media transported from the load unit; a moving unit that is movable in a predetermined main scanning direction; a printing medium detecting unit that is mounted to the moving unit and detects a signal relating to a presence of a printing medium; and a position detecting unit that detects a position of the moving unit, the method comprising:

(a) determining a change in the presence of the printing medium based on the detected signal from the printing medium detecting unit at a time when the moving unit is moved at a predetermined timing in the printing process;

(b) storing a first set of measured positions of the moving unit at a time when the presence of the printing medium changes, calculating a first width using the first set of measured positions, calculating a second width using a second set of measured positions, determining that duplicate transport with a horizontal discrepancy has occurred when the first width calculated using the first set of measured positions is approximately the same as a theoretical width and the second width exceeds the theoretical width by a significant value, and performing a process corresponding to the duplicate transport with a horizontal discrepancy;

(c) when it has been determined that duplicate transport with a horizontal discrepancy has occurred, stopping the printing process performed by the print unit and storing, in a predetermined storage unit, a position of the printing medium at which the printing process for the printing medium has been completed; and (d) when a direction for resuming the printing process, for the printing medium for which the printing process has been stopped, is issued, reading out the position, from the storage unit, at which the printing process is completed, transporting the printing medium to the position at which the printing process had been completed, and controlling the printing unit to perform a printing process.

16. A method of controlling an image printing device that comprises a paper tray that loads a plurality of overlapped printing media; a printing mechanism that performs a printing process for the printing media transported from the paper tray; a carriage that is movable in a predetermined main scanning direction; a printing medium detector that is mounted to the carriage and detects a signal relating to a presence of a printing medium; and a position detector that detects a position of the carriage, the method comprising:

(a) determining a change in the presence of the printing medium based on the detected signal from the printing medium detector at a time when the carriage is moved at a predetermined timing in the printing process;

(b) storing a first set of measured positions of the carriage at a time when the presence of the printing medium changes, calculating a first width using the first set of measured positions, calculating a second width using a second set of measured positions, determining that duplicate transport with a horizontal discrepancy has occurred when the first width calculated using the first set of measured positions is approximately the same as a theoretical width and the second width exceeds the theoretical width by a significant value;

(c) when it has been determined that duplicate transport with a horizontal discrepancy has occurred, stopping the printing process performed by the print mechanism and storing, in a predetermined storage mechanism, a position of the printing medium at which the printing process for the printing medium has been completed; and (d) when a direction for resuming the printing process, for the printing medium for which the printing process has been stopped, is issued, reading out the position, from the storage mechanism, at which the printing process is completed, transporting the printing medium to the position at which the printing process had been completed, and controlling the printing mechanism to perform a printing process.

* * * * *